United States Patent [19]

Boucraut

[11] Patent Number: 4,492,045

[45] Date of Patent: Jan. 8, 1985

[54] APPARATUS FOR DRYING AND STABILIZING PIECES OF WOVEN OR KNITTED FABRIC

[75] Inventor: Frantz M. J. Boucraut, Troyes, France

[73] Assignee: Petit Bateau Valton S.A., Troyes, France

[21] Appl. No.: 446,272

[22] Filed: Dec. 2, 1982

[30] Foreign Application Priority Data

Dec. 15, 1981 [FR] France ..... 81 23407

[51] Int. Cl.[3] ..... F26B 13/00

[52] U.S. Cl. ..... 34/122; 34/157; 34/158

[58] Field of Search ..... 34/105, 157, 158, 122; 26/20, 83; 68/20

[56] References Cited

U.S. PATENT DOCUMENTS

| | | | |
|---|---|---|---|
| 828,017 | 8/1906 | Carleton et al. | 34/157 |
| 3,913,240 | 10/1975 | Flamig | 34/122 |
| 4,084,412 | 4/1978 | Levielle | 68/20 |
| 4,155,227 | 5/1979 | Conti | 26/83 |

FOREIGN PATENT DOCUMENTS

| | | | |
|---|---|---|---|
| 1785141 | 12/1972 | Fed. Rep. of Germany | 68/177 |

*Primary Examiner*—Larry I. Schwartz
*Assistant Examiner*—David W. Westphal
*Attorney, Agent, or Firm*—Gerald J. Ferguson, Jr.; Joseph J. Baker

[57] ABSTRACT

Two openwork drums (8A, 8B) are supported and rotated above an inclined, curved partition (9) having a smooth surface. Dry air is introduced beneath this partition and then flows along an upwardly directed channel (10) to an outlet (11) from which a deflector (12) directs it through the knitted fabric (13) to be dried and through the drums (8A, 8B) to a moist air outlet (5) disposed above the partition (9).

9 Claims, 6 Drawing Figures

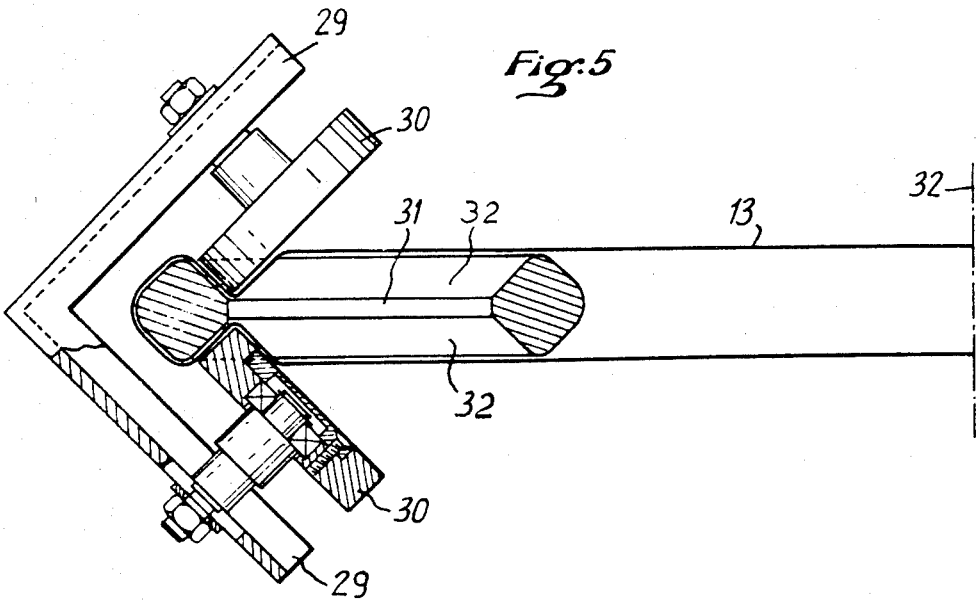
Fig:5
Fig:6
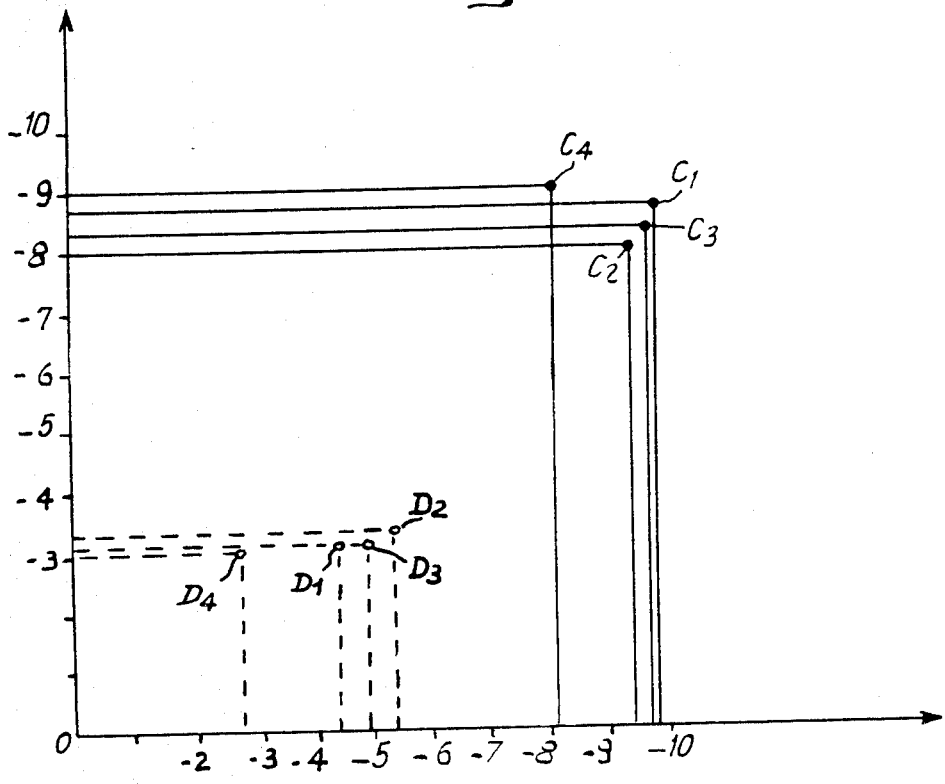

APPARATUS FOR DRYING AND STABILIZING PIECES OF WOVEN OR KNITTED FABRIC

BACKGROUND OF THE INVENTION

1. Field of the Invention

The object of the invention is apparatus for drying pieces of woven or knitted fabric up to 250 m or more in length, that is to say reducing the moisture content from an initial value of between 50 and 60% to approximately 6%. Simultaneously, the apparatus confers dimensional stability on the woven or knitted fabric treated.

2. Description of the Prior Art

There are numerous known forms of drying apparatus and numerous patents disclosing apparatus of various types for carrying out this operation. Nevertheless, there is not, to the knowledge of the present applicant, any document relating to an apparatus of a design comparable to that for which protection is now sought.

The principal objective of the invention is to provide drying apparatus which is simple and economic to manufacture by virtue of its design, efficient in operation, capable of high levels of throughput and offering the further advantage of not marking knitted fabric treated and stabilizing same.

SUMMARY OF THE INVENTION

Apparatus in accordance with the invention comprises an enclosed main housing containing in its upper part at least one transverse shaft driven in rotation and carrying an openwork drum disposed substantially opposite a moist air outlet formed in the adjacent wall. An inclined and curved partition is disposed within the housing, descending from the level of the bottom of the moist air outlet beneath and beyond the drum, with a smooth concave surface directed towards the drum, then being directed upwardly and substantially parallel to the closest wall to a level adjacent the lower face of the drum. In this way, the wall of the housing and the uppermost end part of the partition delimit an upwardly directed channel terminating at an outlet at which is disposed a deflector directed towards the drum. A dry air inlet is formed in the same wall as the moist air outlet, but beneath the curved partition. There is thus within the housing an air circulation circuit extending from the dry air inlet, along the bottom surface of the curved and downwardly directed partition, upward through the upwardly directed channel, towards the drum on deflection by the deflector and thence to the moist air outlet.

In one embodiment of the invention, in order to provide apparatus of greater capacity, the housing is of increased size in the longitudinal direction and contains two transverse shafts each carrying an openwork drum; the curved partition extends beneath both drums and the upwardly directed channel with which the deflector is associated discharges in the vicinity of the drum further away from the moist air outlet.

Preferably, each drum comprises a number of equiangularly spaced members extending radially from the shaft. Preferably, these members terminate at a convex edge which is provided with a facing material which prevents slipping of the woven or knitted fabric to be dried.

It is advantageous, in accordance with the invention, to include within the housing, beneath the outlet from the upwardly directed channel, a stenter for the knitted or woven fabric treated. The stenter is preferably of the ring type, and preferably comprises a non-captive toroidal ring whose profile has two frusto-conical surfaces each cooperating with a cylindrical roller.

When the apparatus in accordance with the invention is in operation, dry air, preferably heated to a temperature between 70° and 100° C., is fed into the air circuit inlet, beneath the curved partition. This air warms the partition and is then directed by the deflector through the woven or knitted fabric and through the drum or drums, before leaving through the moist air outlet. The woven or knitted material being treated is in the form of an endless loop around the drum or drums, by means of which it is moved continuously. Its length is substantially greater than the separation between the shafts and the distance separating the shafts from the curved partition, so that numerous folds form and slide on the air-heated partition.

Other objects and advantages will appear from the following description of examples of the invention, when considered in connection with the accompanying drawings, and the novel features will be particularly pointed out in the appended claims.

BRIEF DESCRIPTION OF THE DRAWINGS

FIG. 5 is a view from above as shown by the arrows F—F in FIG. 2, showing one half of a stenter in accordance with the invention.

FIG. 6 is a graph showing the stabilization of knitted fabric achieved with the apparatus in accordance with the invention.

DESCRIPTION OF THE PREFERRED EMBODIMENTS

Apparatus in accordance with the invention comprises an enclosed main housing of parallelpipedal shape containing at least one transverse shaft driven in rotation to which is keyed a rotating drum. Structures of this kind are known in the textile piece processing art. An example will be found in French Pat. No. 2 315 563, although the apparatus therein described is intended only for dying textile pieces.

The merit of the invention consists in the realization that the dying apparatus structure is perfectly suited to the drying of textile pieces. There is a major and immediate advantage in that this structure is simple, being significantly simpler than the structure of conventional drying apparatus.

The apparatus described in the aforementioned patent cannot be used as a dryer since it is designed specifically and exclusively for dying. Basing itself on the structure of this dying apparatus, the invention provides simple and specific means to make the structure usable for drying and economical when used for this purpose. Also, the resulting apparatus is superior to conventional drying apparatus by virtue of its improved stabilizing effect.

Figure 1:
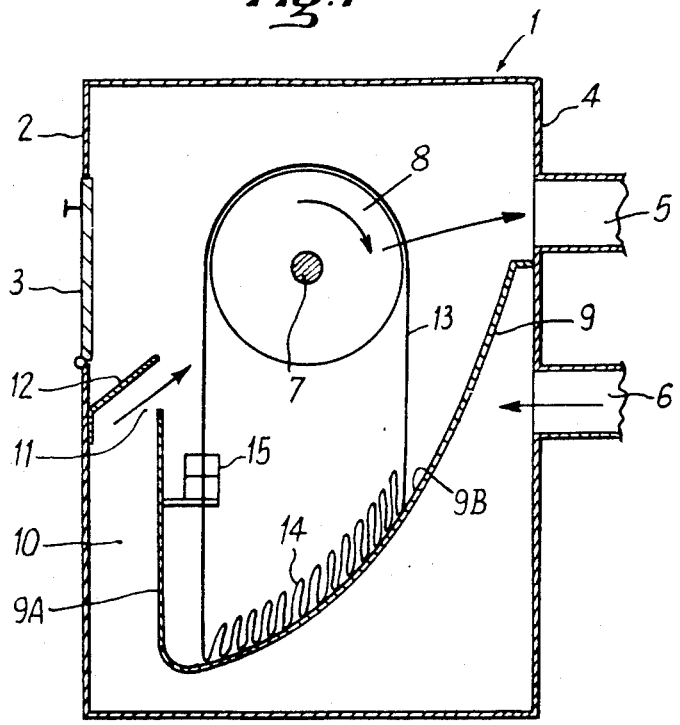
FIG. 1 is a simplified view in cross-section on its median plane of a single-drum apparatus in accordance with the invention.
Figure 3:
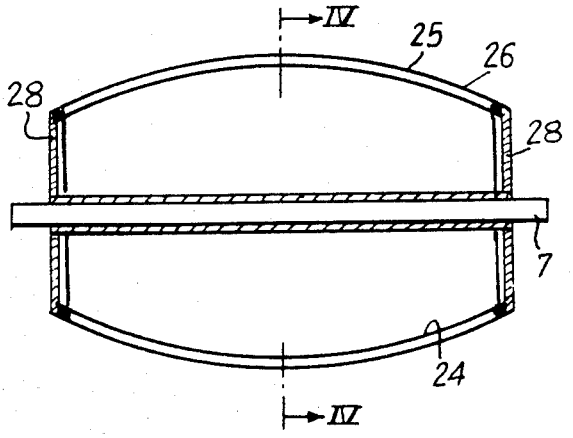
FIG. 3 is a detail view in elevation to a larger scale showing the drum profile.
Figure 4:
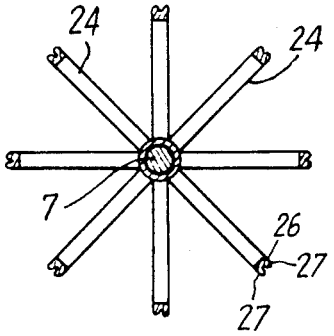
FIG. 4 is a cross-section on the line IV—IV in FIG. 3.

FIG. 1 shows a first aspect of the invention. An enclosed housing 1 of sheet metal supported by a framework includes in its front wall 2 a loading and unloading hatch 3. The opposite rear wall 4 has in its upper part a moist air outlet 5 and, at a lower position, a dry air inlet 6. Supported between the side walls which extend between front wall 2 and rear wall 4 is a transverse shaft 7 coupled to a motor which drives it in rotation. Keyed to shaft 7 so as to rotate with it is a drum 8 whose precise construction will be described later.

An internal partition 9 extends away from rear wall 4 from a point below moist air outlet 5 and above dry air inlet 6; it is downwardly inclined and descends below drum 8, extending beyond the latter to terminate in a terminal section 9A, preferably vertical, parallel to front wall 2. The latter and terminal part 9A of partition 9 define an upwardly directed channel 10 which ends at an outlet 11 with which is associated a deflector 12. The latter extends away from the edge of outlet 11 closest front wall 2 and is inclined in the direction towards drum 8. The position of outlet 11 and the inclination of deflector 12 are not of critical importance. However, it is desirable that the height of outlet 11 be at most equal to and for preference less than the height to the lowest point on drum 8, and that deflector 12 be directed substantially towards shaft 7.

Internal partition 9 is curved, at least in that portion situated beneath drum 8; it presents to the latter a smooth concave surface 9B. The woven or knitted fabric 13 to be dried is formed into a closed loop and supported from within by drum 8 so as to hang freely until it rests on smooth surface 9B, on which it forms numerous transverse folds 14.

Internal partition 9 creates within the bottom section of housing 1 an air circulation circuit which extends from dry air inlet 6, along the bottom surface of partition 9 (that opposite its smooth upper surface 9B), along upwardly directed channel 10, through knitted fabric 13 and drum 8, to which it is directed by deflector 11, to moist air outlet 5.

Above internal partition 9, at a height at most equal to and for preference less than that of outlet 11, appropriate means attached to the framework of housing 1 or to internal partition 9 support a stenter 15 which will be described in detail later.

Figure 2:
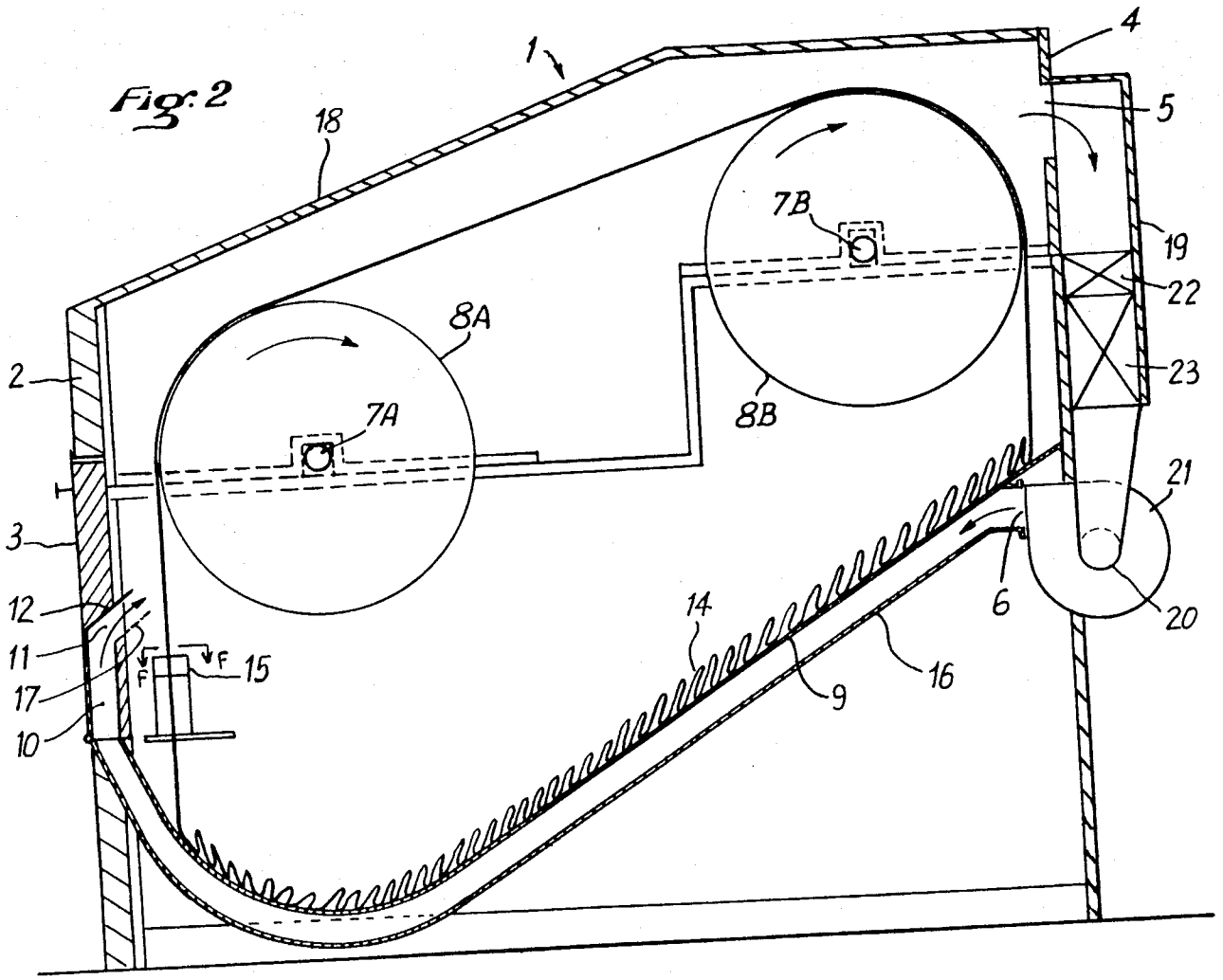
FIG. 2 is a simplified view in cross-section on its median plane of a twin-drum apparatus in accordance with the invention.

FIG. 2 shows a second aspect of the invention, in the form of apparatus of greater capacity. Overall, this comprises the same component parts as the apparatus shown in FIG. 1; the same reference numerals are therefor used to designate these.

The housing 1 in FIG. 2 is larger in the longitudinal direction so as to accommodate two shafts 7A, 7B spaced from one another and carrying respective drums 8A, 8B. Drums 8A, 8B are separated longitudinally and, for preference, front drum 8A nearer front wall 2 is lower than rear drum 8B nearer rear wall 4. The difference in level between drums 8A, 8B is not of critical importance. It renders front drum 8A more accessible for loading an unloading operations and places rear drum 8B on an upward line which facilitates installation of inclined internal partition 9 parallel to this line.

In this embodiment, partition 9 is flat in that part situated beneath rear drum 8B, its curvature beginning beneath front drum 8A. Because of the greater volume of housing 1, a second internal partition 16 is disposed parallel to and below partition 9 so as to provide better ducting for the dry air and to ensure improved contact between this air and partition 9.

Hatch 3 is at a lower level in front wall 2, partly in front of front drum 8A. It is double-skinned and when in its closed position constitutes channel 10 extending the circuit formed between partitions 9 and 16. Deflector 12 is mounted on hatch 3 at outlet 11 from upwardly directed channel 10. If considered desirable for improved direction of the airflow, a second deflector 17 may be mounted on the inside edge of outlet 11, close to front drum 8A. Above deflector 12 hatch 3 is solid or single-walled; this part may be glazed to permit monitoring of operation.

The top wall 18 of housing 1 is substantially parallel to the line joining shafts 7A and 7B, for improved guidance of the circulating air.

In this embodiment, moist air outlet 5 is connected by trunking 19 to the intake orifice 20 of a fan 21. The latter has its outlet orifice connected to dry air inlet 6. If required, filter means 22 and/or air drying means 23 may be installed on trunking 19. In this apparatus, the air circulates in a closed cycle.

The knitted or woven material 13 to be dried rests on the two drums 8A and 8B and hangs down on to the smooth, curved and inclined surface of internal partition 9, on which it forms numerous folds 14.

The two shafts 7A and 7B are driven in rotation at the same speed by a common motor (not shown), in the direction indicated by the arrows.

In the embodiments described herein, drum 8 and drums 8A and 8B are rotated at a speed such that the rate of displacement of knitted fabric 13 is between 20 and 120 m/min; a satisfactory value for this rate of displacement is 80 m/min. When the drum rotation speed is too low knitted fabric 13 slips relative to the drums. There may also be relative slipping if the speed is too high. Friction between the knitted fabric and the drums must be avoided at all costs, as this results in lustring of the knitted fabric. Lustring is not the only type of damage hazard to be avoided. Measures must also be taken to prevent the folds leaving permanent traces which would have to be removed subsequently.

Drums 8 are designed to contribute to the elimination of this risk.

Each drum 8 or 8A, 8B is of openwork construction; it comprises, in addition to shaft 7, a number of (preferably eight) diametrically disposed and equi-angularly spaced frames 24. Each frame 24 has two convex opposite edges 25 and each edge 25 is fitted with a non-skid strip 26, a rubber strip, for example, preferably with two parallel beads 27. Each strip 26 is made from rubber and is bonded to or engaged in an appropriate groove along the respective convex edge 25. At their ends (as seen in the direction of shaft 7), frames 24 are attached to transverse flanges 28.

The air leaving outlet 11 can pass through drum 8 or each drum 8A, 8B to moist air outlet 5. Thanks to convex edges 25, the drums assist in maintaining the woven or knitted fabric 13 spread out in the transverse direction without the formation of longitudinal folds.

To be more sure of the knitted fabric remaining spread out during treatment, a stenter 15 is disposed on its path of movement, beneath the level of outlet 11. The stenter is a device known per se in its entirety and already used as such in conventional drying apparatus. In all forms of drying apparatus it is important to prevent the formation of longitudinal folds. The formation of such folds closes up the woven or knitted material in the transverse direction, which prejudices the efficiency of the drying process; also, such longitudinal folds have no tendency to open out and disappear of their own accord. On the contrary, they tend to remain and to worsen to the point at which traces or marks are left which have to be removed subsequently by appropriate calendering.

As stenter 15 is known, it will not be described in detail. It extends transversely, in the direction parallel to shafts 7, 7A, 7B. It is designed to operate on knitted fabric 13 made on a circular loom in the form of a large-diameter tube. This tube is flattened by folding it in a diametral plane and rests in double thickness on drums 8, 8A, 8B and inclined partition 9. Stenter 15 comprises a support transverse to the tube on which are mounted two stenter devices, the separation between which is adjustable. Each stenter device comprises (FIG. 5) two arms 29 disposed at 90° and each carrying a roller 30. The two rollers 30 are themselves arranged at 90° to one another, defining between their peripheries a space through which passes a toroidal ring 31. Rollers 30 are driven in rotation by means which are not shown, and toroidal ring 31 is free to rotate. Knitted fabric 13 is disposed so as to pass between rollers 30 and to contain ring 31. When the two stenter devices are moved apart on opposite sides of the main stenter axis 32, knitted fabric 13 is held between rollers 30 and ring 31 and stretched in the transverse direction.

Preferably, and in accordance with the invention, stenter 15 is the subject of an improvement which contributes to avoiding the formation of undesirable traces on the knitted fabric. One aspect of the object of the invention is to remove unwanted traces from the knitted fabric treated more efficiently than conventional drying apparatus.

A conventional stenter 15 may be suitable for certain materials which are not much prone to creasing. In the case of delicate materials, the improvement to stenter 15 in accordance with the invention becomes necessary. This improvement consists in the fact that rollers 30 are cylindrical and toroidal ring 31 has two frusto-conical surfaces 32. The width and inclination of surfaces 32 correspond to those of the cylindrical surfaces of the two rollers 30. Thus knitted fabric 13 is held between surfaces which roll in a synchronous manner and with the greatest possible width of contact.

In order to dry knitted fabric manufactured in the form of a tube as previously mentioned, a number of sections are sewn together end to end to produce a total length of 250 to 500 m. The fabric is passed over drum 8 (FIG. 1) or over the two drums 8A and 8B (FIG 2); it is supported at the bottom by inclined and curved partition 9. This is relatively close to drum 8 or drums 8A, 8B, as a result of which knitted fabric 13 forms numerous transverse folds 14. Knitted fabric 13 passes through stenter 15 before it is exposed to the dry air from outlet 11. As has already been mentioned, this air passes through drum 8 or drums 8A, 8B to outlet 5. The knitted fabric is rotated in a closed loop, at the peripheral speed of the drum or drums, which is preferably of the order of 50 to 80 m/min, without slipping.

The drying air introduced through inlet 6 is warmed to a temperature of 75° to 95° C. This air flows along the bottom surface of inclined partition 9 until it arrives at upwardly directed channel 10. Thus partition 9 is warmed and contributes to the drying action by virtue of its contact with folds 14, so speeding up the drying process. With apparatus like that shown in FIG. 1, knitted fabric containing 50% moisture in the form of a 250 m long tube folded to double thickness is dried to a moisture content of 6% after 30 minutes with drum 8 rotating at a peripheral speed of 80 m/min and 16 $m^3/h$ of air blown in through inlet 6.

Throughout the drying period, knitted fabric 13 descends from drum 8 or 8B, contacts partition 9 and collects on the latter with a sliding motion forming transverse folds 14. These are created naturally and are constantly in movement, being opened as the knitted fabric is raised towards stenter 15. This natural movement of the knitted fabric has proven to be highly favourable to its stabilization. The stresses imposed on the yarn during knitting are relieved and the stitches take up their final position. A similar, although necessarily less extensive, effect is obtained with woven fabrics.

Comparative tests carried out using drying apparatus like that shown in FIG. 1 and conventional apparatus with 18 heating rollers have shown that the invention produces a higher degree of stabilization. The results obtained are reported on FIG. 6. On this graph, the residual lengthwise shrinkage in percent is plotted along the abscissae and the widthwise residual shrinkage in percent along the ordinates. The black points C1, C2, C3 and C4 correspond to the shrinkage of knitted fabrics dried using conventional apparatus with 18 heating rollers and the white points D1, D2, D3 and D4 represent the shrinkage of knitted fabrics dried with drying apparatus like that of FIG. 1. Each point represents the average value of measurements taken on 90 samples. Points C1, D1 relate to a dyed knitted fabric with 1/1 rows in 17 Tex cotton yarn, points C2 and D2 to a dyed knitted fabric with 3/3 rows in 17 Tex cotton yarn, points C3 and D3 to dyed and natural-colored knitted fabric with 1/1 rows in 17 Tex cotton yarn, and points C4 and D4 to natural-colored knitted fabric with 1/1 rows in 17 Tex cotton yarn. The lengthwise residual shrinkage is between 2.5 and 5.5% for points D1 to D4, whereas it is between 8 and 10% for points C1 to C4. The widthwise residual shrinkage is between 3 and 3.5% for points D1 to D4 and between 8 and 9% for points C1 to C4. This clearly shows the superior stabilizing effect of the apparatus in accordance with the invention. The method of measuring residual shrinkage was the same in each case. The outline of a plate 20×20 cm was marked on the knitted fabric prior to washing and drying the fabric using the method defined in French Standard G 07-136.

It will be understood that various changes in the details, materials and arrangements of parts, which have been herein described and illustrated in order to explain the nature of the invention, may be made by those skilled in the art within the principle and scope of the invention as expressed in the appended claims.

What I claim is:

1. Apparatus for drying pieces of woven or knitted fabric formed as an endless loop of material, comprising an enclosed main housing having a front wall and a rear wall, a hatch in said front wall, means for providing dry air, a dry air inlet in said rear wall for passing dry air into the main housing, a moist air outlet in said rear wall, at least one transverse rotatable shaft, means for driving said shaft in rotation, an openwork barrel-shaped drum disposed on said shaft opposite said moist air outlet, said drum supportingly receivable of a first portion of said endless loop of material, a downwardly sloping partition extending from said rear wall at a point below said moist air outlet towards said front wall and having a smooth surface directed towards said drum, at least a portion of said smooth surface being concave toward said drum, said smooth surface being slidingly supportable of a second portion of said endless loop of material formed in regular and natural folds, an upwardly directed channel communicating with said partition, an outlet from said channel situated at a point not higher than the bottom of said drum, and at least one deflector at said outlet directed towards said transverse shaft, said dry air inlet being disposed beneath said partition, whereby, in operation, rotation of said drum causes rotation of said endless loop of material about said drum causing fabric to be lifted from said smooth surface passed over said drum and returned to said smooth surface, said fabric returned to said smooth surface forming regular and natural folds which slide down said smooth surface, while dry air enters through said inlet, passes beneath said partition, upwardly through said channel and channel outlet and passes through said material and said drum and is removed via said moist air outlet.

2. Apparatus according to claim 1, comprising two spaced transverse shafts disposed between said front and rear walls and a respective drum on each of said shafts.

3. Apparatus according to claim 2, wherein one of said drums is closer to said rear wall than the other of said drums and higher than said other drum.

4. Apparatus according to claim 2, further comprising a second partition disposed beneath and parallel to said inclined partition so as to define therewith a passage into which said dry air inlet opens and with which said upwardly directed channel communicates.

5. Apparatus according to claim 4, wherein said hatch has a double skin and said upwardly directed channel continues through said hatch when in its closed position, said outlet and said deflector being disposed on said hatch.

6. Apparatus according to claim 1, further comprising a stenter disposed above said concave portion of said partition at a height not greater than and preferably less than that of said dry air outlet.

7. Apparatus according to claim 6, wherein said stenter comprises two cylindrical rollers and a toroidal ring disposed between said rollers, said ring having two frusto-conical surfaces on which roll respective rollers.

8. Apparatus according to claim 1, wherein said drum comprises a plurality of diametrically disposed frames angularly spaced about the shaft.

9. Apparatus according to claim 8, comprising a respective non-skid strip on each of two opposite edges of each of said frames.

* * * * *